US009920636B2

(12) United States Patent
Brandl

(10) Patent No.: US 9,920,636 B2
(45) Date of Patent: Mar. 20, 2018

(54) TURBINE BLADE OR VANE

(71) Applicant: ALSTOM Technology Ltd, Baden (CH)

(72) Inventor: Herbert Brandl, Waldshut-Tiengen (DE)

(73) Assignee: ANSALDO ENERGIA IP UK LIMITED, London (GB)

( * ) Notice: Subject to any disclaimer, the term of this patent is extended or adjusted under 35 U.S.C. 154(b) by 179 days.

(21) Appl. No.: 14/499,386

(22) Filed: Sep. 29, 2014

(65) Prior Publication Data

US 2015/0017007 A1 Jan. 15, 2015

Related U.S. Application Data

(63) Continuation of application No. PCT/EP2013/056610, filed on Mar. 27, 2013.

(30) Foreign Application Priority Data

Mar. 30, 2012 (EP) ..... 12162372

(51) Int. Cl.
*F01D 5/22* (2006.01)
*F01D 5/14* (2006.01)
(Continued)

(52) U.S. Cl.
CPC ..... *F01D 5/22* (2013.01); *F01D 5/147* (2013.01); *F01D 5/3007* (2013.01); *F01D 5/326* (2013.01);
(Continued)

(58) Field of Classification Search
CPC ..... F01D 5/22; F01D 5/147; F01D 5/3007; F01D 5/326; F01D 11/008; F05D 2230/50; F05D 2230/51; F05D 2240/80
See application file for complete search history.

(56) References Cited

U.S. PATENT DOCUMENTS 2,825,530 A 3/1958 Schum et al.
3,801,222 A * 4/1974 Violette ..... F01D 5/3007 416/193 A
(Continued)

FOREIGN PATENT DOCUMENTS

EP 1 882 814 A2 1/2008
EP 1 992 787 A1 11/2008
(Continued)

OTHER PUBLICATIONS

Jan. 10, 2017 Notification of Reasons for Refusal issued in Japanese Application No. 2015-502343 (English language translation).

*Primary Examiner* — Richard Edgar
*Assistant Examiner* — Michael Sehn
(74) *Attorney, Agent, or Firm* — Buchanan Ingersoll & Rooney PC

(57) ABSTRACT

The invention relates to a turbine blade, including a blade having a front edge and a rear edge, which blade transitions by means of a shaft into a blade root designed for fastening the turbine blade, and including a platform, which is arranged at the lower end of the blade in order to bound a flow channel. The platform is designed as a separate component and can be connected to the blade in a form-fit manner. Flexible application is achieved in that the platform is composed of several individual platform elements, which enclose the blade in the assembled state.

12 Claims, 6 Drawing Sheets

(51) Int. Cl.

| | |
|---|---|
| ***F01D 5/30*** | (2006.01) |
| ***F01D 5/32*** | (2006.01) |
| ***F01D 11/00*** | (2006.01) |

(52) U.S. Cl.

CPC ..... *F01D 11/008* (2013.01); *F05B 2240/57* (2013.01); *F05D 2230/50* (2013.01); *F05D 2230/51* (2013.01); *F05D 2240/55* (2013.01); *F05D 2240/57* (2013.01); *F05D 2240/80* (2013.01); *F05D 2260/30* (2013.01); *F05D 2260/31* (2013.01); *F05D 2260/36* (2013.01); *F05D 2260/96* (2013.01)

(56) References Cited

U.S. PATENT DOCUMENTS

| | | | | |
|---|---|---|---|---|
| 4,583,914 | A | 4/1986 | Craig et al. | |
| 4,650,399 | A | 3/1987 | Craig et al. | |
| 5,797,725 | A | 8/1998 | Rhodes | |
| 7,762,781 | B1 | 7/2010 | Brown et al. | |
| 7,972,113 | B1 | 7/2011 | Davies | |
| 2007/0189901 | A1 | 8/2007 | Dundas et al. | |
| 2008/0298973 | A1* | 12/2008 | Marini ..... | F01D 5/147<br>416/223 R |
| 2011/0142684 | A1 | 6/2011 | Campbell et al. | |
| 2011/0243746 | A1* | 10/2011 | Liotta ..... | F01D 5/282<br>416/214 R |

FOREIGN PATENT DOCUMENTS

| | | | |
|---|---|---|---|
| EP | 2 189 626 | A1 | 5/2010 |
| JP | A-2010-159748 | | 7/2010 |
| JP | A-2011-58497 | | 3/2011 |
| WO | 98/53212 | | 11/1998 |

* cited by examiner

TURBINE BLADE OR VANE

CROSS-REFERENCE TO RELATED APPLICATIONS

This application claims priority to PCT/EP2013/056610 filed Mar. 27, 2013, which claims priority to European application 12162372.2 filed Mar. 30, 2012, both of which are hereby incorporated in their entireties.

TECHNICAL FIELD

The present invention concerns the field of turbomachines. It relates to a turbine blade or vane, as is used as a guide vane or rotor blade in particular in gas turbines.

BACKGROUND

Blades or vanes for gas turbines, which are used in the compressor part or turbine part as guide vanes or rotor blades, are usually produced as one part by forging or investment casting. This also applies in particular to blades or vanes which have a platform and/or a shroud segment.

The loading of guide vanes and rotor blades in the gas turbine is increased by the continuously encouraged increase in the hot gas temperature and the reduction of the cooling air consumption. It is therefore desirable to reduce stresses which arise on the blades or vanes by design measures. Components which experience reduced levels of stress can withstand higher temperatures with the same service life. In this way, it is possible to accommodate for the demand for a higher hot gas temperature and a lower cooling air consumption.

EP 2 189 626 A1 discloses a rotor blade arrangement for a gas turbine, which rotor blade arrangement can be fastened to a blade carrier and comprises in each case a main blade part element and a platform element, wherein the platform elements of a blade row form a continuous inner shroud. A reduced level of stress is achieved therein by virtue of the fact that the blade airfoil element and the platform element are formed as separate elements and can each be fastened to the blade carrier separately. A disadvantage of this solution is that it is not suitable for retrofit tasks, because the nature of the fastening to the rotor changes by virtue of the platform element, and therefore the rotor itself has to be adapted.

U.S. Pat. No. 7,762,781 B1 discloses an arrangement made up of a turbine blade or vane and a platform, in which the platform is formed as a separate element which is fastened to the blade or vane by special pins. This solution has the disadvantage that the individual elements are very expensive to produce.

SUMMARY

It is an object of the invention to specify a turbine blade or vane which avoids the disadvantages of known turbine blades or vanes and is distinguished by the fact that use is made of a separate platform which can be attached to the rotor without any change on the fastening side.

The turbine blade or vane according to the invention comprises a blade or vane airfoil with a leading edge and a trailing edge, which merges via a shaft into a blade or vane root formed for the fastening of the turbine blade or vane, and also a platform, which is arranged at the lower end of the blade or vane airfoil to delimit a flow channel, wherein the platform is formed as a separate component and can be connected to the blade or vane airfoil with a positive fit. The turbine blade or vane according to the invention is distinguished by the fact that the platform is composed of a plurality of individual platform elements, which, when assembled, enclose the blade or vane airfoil. The composite design of the platform makes it possible to fasten the latter directly to a blade or vane, such that adjustments in the region in which the blade or vane is fastened can be avoided.

According to one embodiment of the invention, the platform is composed of two platform elements.

Another embodiment of the invention is characterized in that the two platform elements, when assembled, butt against one another with joint surfaces in a separating plane which extends from the leading edge or, respectively, the trailing edge of the main blade or vane part in an axial direction with respect to the associated edge of the platform.

In particular, the platform elements are each provided with recesses which proceed from the separating plane and, when assembled, form an opening adapted to the profile of the blade or vane airfoil for the blade or vane airfoil passing through the platform.

It is preferred that the platform is sealed off with respect to the main blade or vane part.

In particular, a circumferential sealing groove, which receives an appropriate seal, is made in the platform elements for sealing off with respect to the blade or vane airfoil along the opening.

According to another embodiment of the invention, the two platform elements are sealed off with respect to one another in the separating plane.

In particular, a sealing groove, which receives a matching seal, is provided for sealing off in the separating plane.

A further embodiment of the invention is characterized in that the two platform elements are releasably connected to one another.

In particular, the two platform elements can be screwed or riveted to one another.

It is preferred that flange sections which are oriented parallel to the separating plane, butt against one another in the separating plane and through which the two platform elements are screwed or riveted to one another are formed on the two platform elements.

According to a further embodiment of the invention, the two platform elements are locked to one another by locking means.

In particular, the platform elements, when assembled, overlap one another with overlapping sections, wherein a locking channel is formed in the overlapping region between the overlapping sections, and the locking channel is filled with a filling.

According to a further embodiment of the invention, the platform is fastened to the turbine blade or vane.

In particular, the platform is hooked to the turbine blade or vane.

It is preferred that the platform or the platform elements is (are) equipped with hooks, by way of which it (they) is (are) hooked into a groove in the region of the shaft of the turbine blade or vane.

Alternatively, the platform or the platform elements can be integrally connected to the turbine blade or vane.

According to a particularly preferred variant, the platform or the platform elements is (are) connected to the turbine blade or vane by means of a filling poured into a locking channel, in such a manner that the joint surfaces of a section of the turbine blade or vane and of the platform or of the platform elements are equipped with opposing recesses, which together form a cavity that is suitable for being filled with a solidifying filler, for example a molten metal.

BRIEF EXPLANATION OF THE DRAWINGS

The invention will be explained in more detail hereinbelow on the basis of exemplary embodiments in conjunction with the drawing, in which.

DETAILED DESCRIPTION

Figure 2:
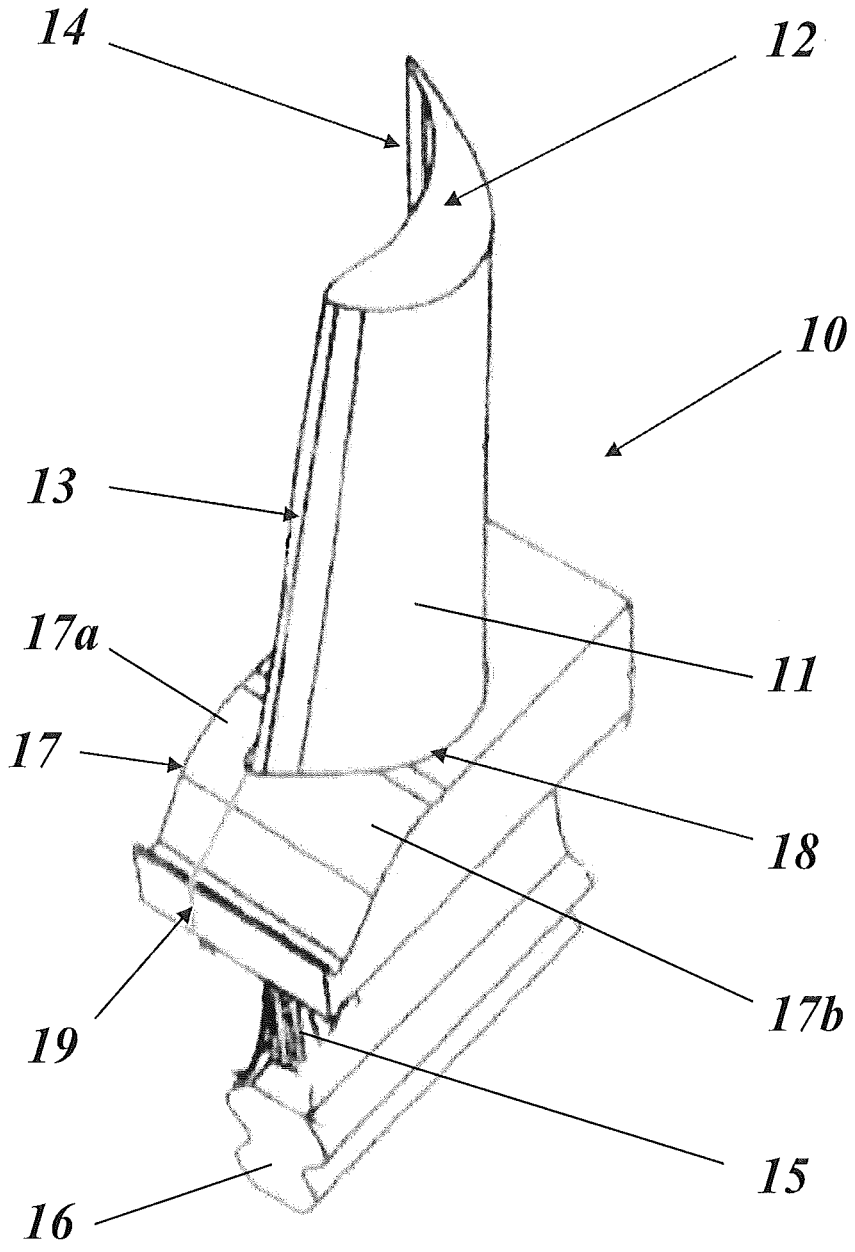
FIG. 2 shows, in a perspective view, a turbine blade or vane having a platform as shown in FIG. 1.

FIG. 2 shows, in a perspective view, a turbine blade or vane having a platform according to one exemplary embodiment of the invention. The turbine blade or vane 10, which for example can be a rotor blade or a guide vane of a gas turbine, comprises a blade or vane airfoil 11, which ends at the top in a blade or vane tip 12 and has a leading edge 13 and a trailing edge 14. The blade or vane airfoil 11 merges downward into a shaft 15, this being adjoined by a blade or vane root 16, which is formed like a fir tree in a manner known per se in order to be inserted into a corresponding receptacle on the rotor.

Figure 1:
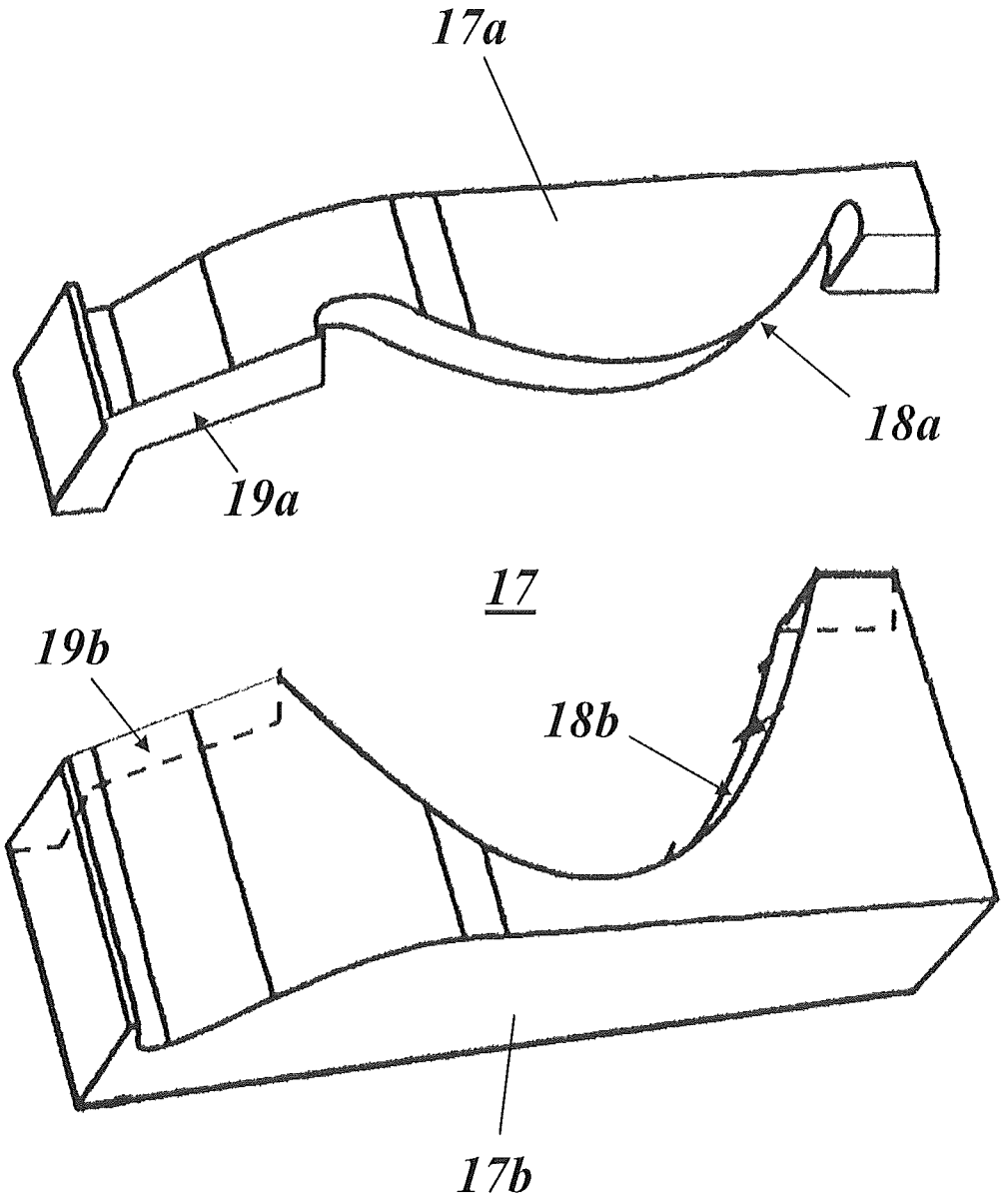
FIG. 1 shows, in a perspective view, a platform which can be assembled from two individual elements, according to one exemplary embodiment of the invention.

At its lower end, the blade or vane airfoil 11 is surrounded by a platform 17, which, as shown in FIG. 1, is composed of two separate platform elements 17*a* and 17*b* in a separating plane 19, the two platform elements 17*a, b* butting against one another with corresponding joint surfaces 19*a* and 19*b* (FIG. 1). Proceeding from the joint surfaces 19*a* and 19*b*, recesses 18*a* and 18*b* are made in the two platform elements 17*a, b*, said recesses forming an opening 18, when the platform 17 is assembled, through which the blade or vane airfoil 11 can extend (FIG. 2). As can be gathered from FIGS. 1 and 2, the separating plane 19 extends on both sides of the blade or vane airfoil 11 in an axial direction from the leading edge 13 to the front edge of the platform 17 and, respectively, from the trailing edge 14 to the rear edge of the platform 17.

Figure 3:
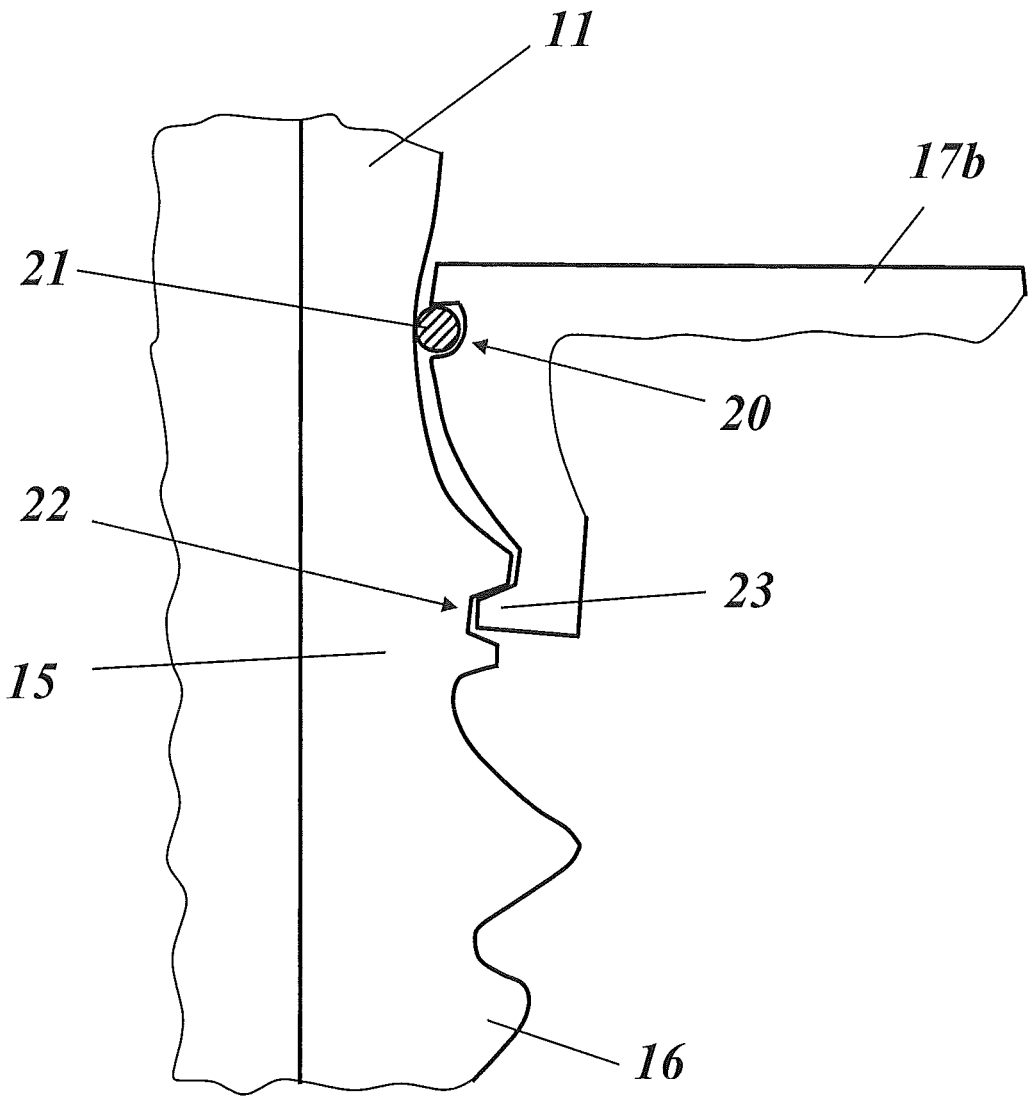
FIG. 3 shows, in a sectional view, the way in which a platform element is sealed off with respect to the blade or vane airfoil in the arrangement as shown in FIG. 2.

FIG. 3 shows, by way of example, the way in which the platform elements 17*a, b* are fastened to the blade or vane airfoil 11 and also the corresponding seal between the platform elements 17*a, b* and the blade or vane airfoil 11. For fastening purposes, that side of the platform elements 17*a, b* which faces toward the blade or vane airfoil 11 is provided with hooks 23, by way of which the platform elements 17*a, b* engage into a corresponding groove 22 on the shaft 15 of the blade or vane. In this way, the blade or vane root 16 remains free of any interference by the platform 17. To provide a seal, a circumferential sealing groove 20, which receives a matching seal 21, is provided in the platform elements 17*a, b* at the edge which faces toward the opening 18.

Figure 4:
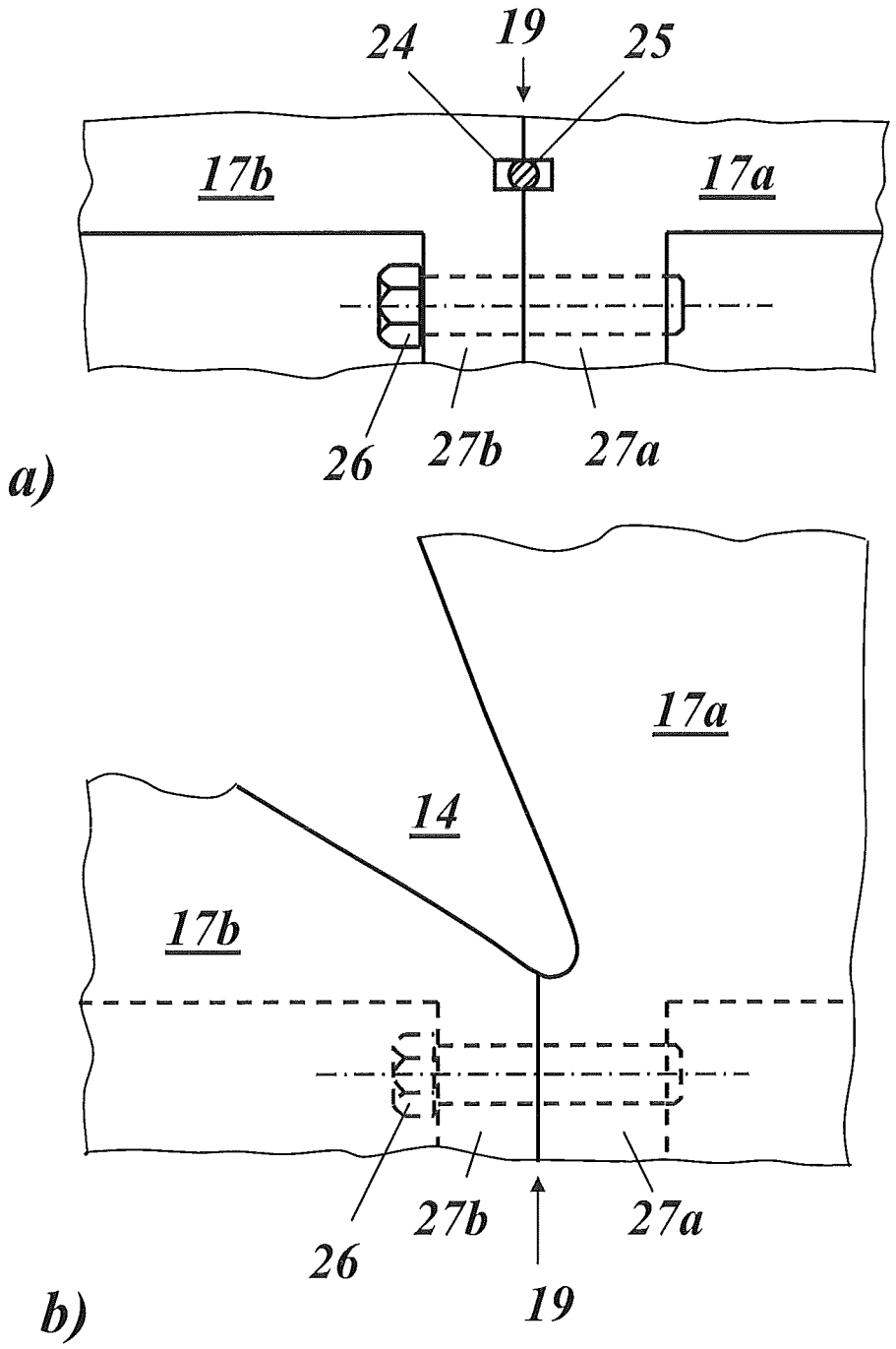
FIG. 4 shows, in the side view (*a*) and the plan view from above (*b*), an exemplary embodiment of a screwed platform according to the invention.

The two platform elements 17*a* and 17*b* can be connected in different ways. FIG. 4 shows, by way of example, a screwed connection of the two elements. To this end, flange sections 27*a, b* which are oriented parallel to the separating plane 19, butt against one another in the separating plane 19 and through which the two platform elements 17*a, b* are connected to one another by means of a connecting element 26, in particular in the form of a stud, are formed on the two platform elements 17*a, b*. Instead of the stud, it is also possible to use a rivet. As is shown in FIG. 4(*a*), a seal can also be provided between the platform elements 17*a, b* in the separating plane 19. For this purpose, a sealing groove 24, which receives a matching seal 25, is formed in the separating plane 19.

Instead of the detachable screwed connection, the platform elements 17*a, b* can also be connected integrally by means of welding or soldering, however.

Figure 5:
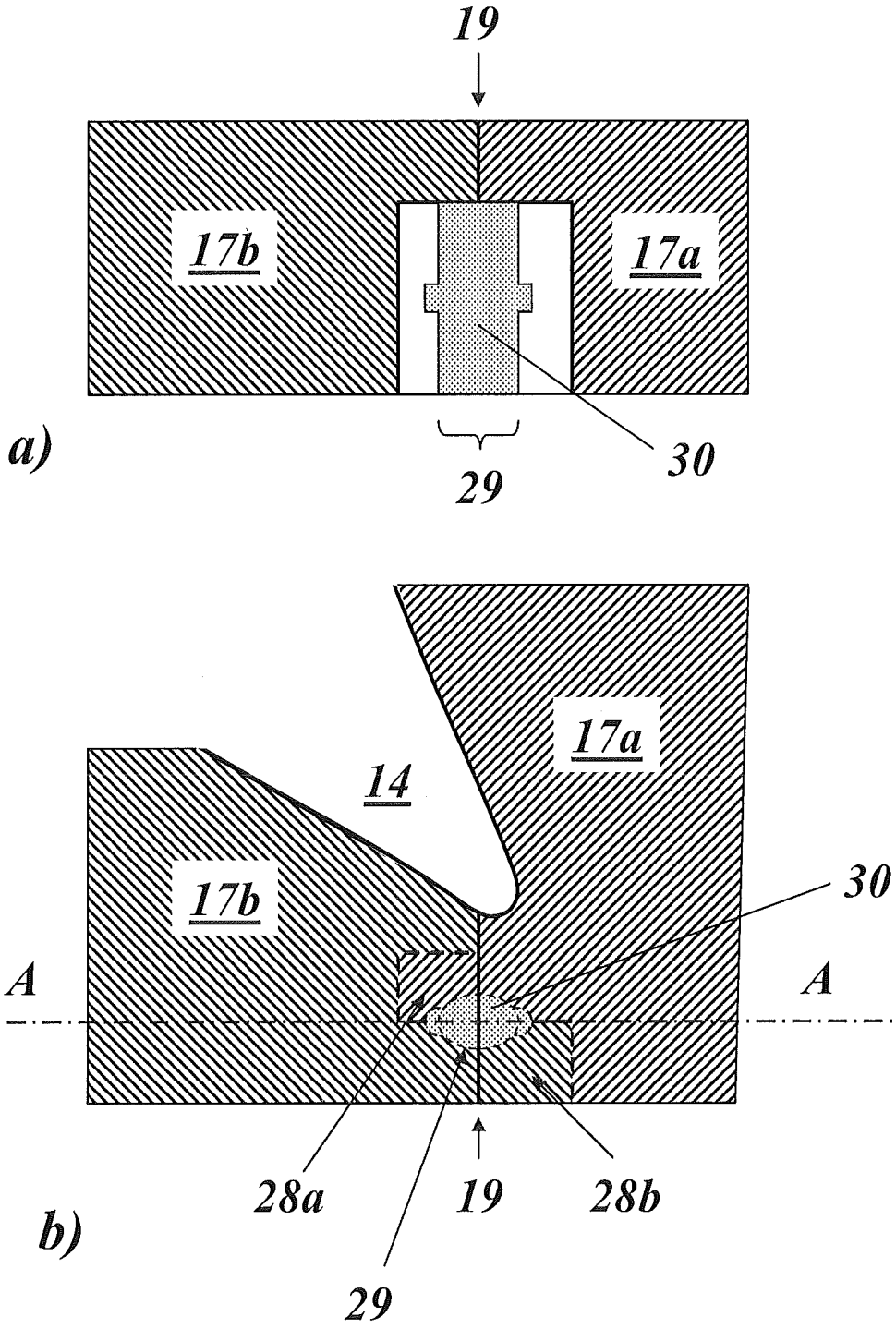
FIG. 5 shows, in the side view (*a*) and the plan view from above (*b*), an exemplary embodiment of a locked platform according to the invention.

As a further possibility for connecting the platform elements 17*a, b*, FIG. 5 shows a special type of locking, which is known under the keyword "bi-cast" and is described, for example, in U.S. Pat. No. 5,797,725. In this case, the two platform elements 17*a, b* overlap with corresponding overlapping sections 28*a* and 28*b*, a locking channel 29 being formed in the overlapping region and being filled with a metallic filling 30, after the platform elements 17*a, b* have been joined together, which then reliably prevents a relative movement between the overlapping sections 28*a, b*. As the section along the plane A-A from FIG. 5(*b*), as is shown in FIG. 5(*a*), makes clear, laterally protruding lugs of the filling 30 can be provided in the locking channel 29, in order to prevent the filling 30 from slipping out in the longitudinal direction of the connecting channel 29.

Figure 6:
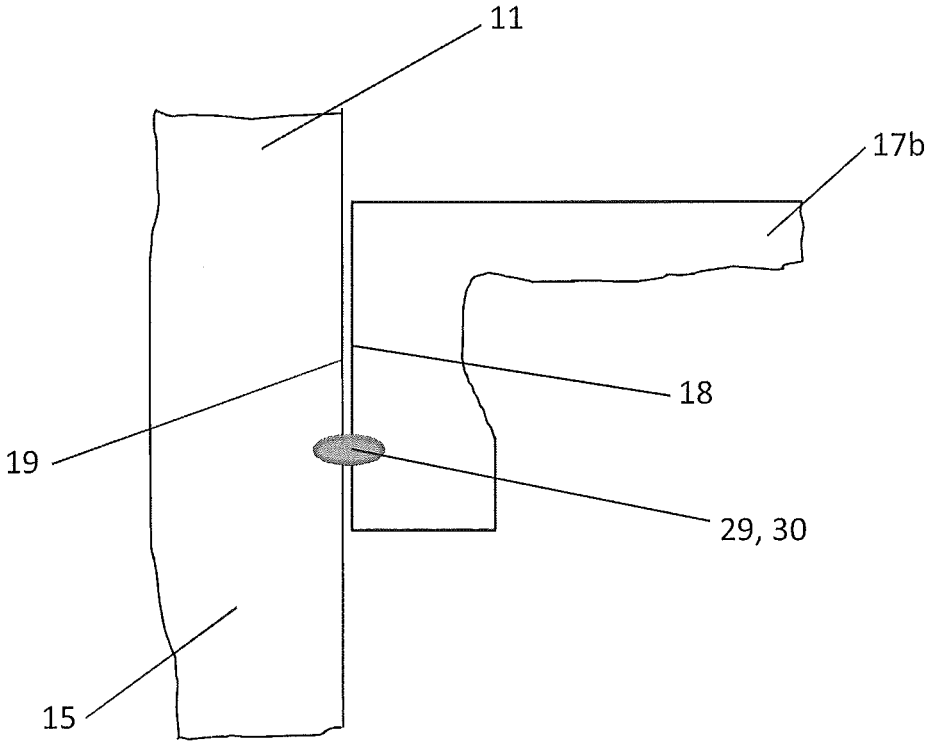
FIG. 6 shows an alternative embodiment of the way in which a platform element is fastened and sealed off with respect to the blade or vane airfoil in the arrangement as shown in FIG. 2.

FIG. 6 shows, as an alternative to that shown in FIG. 3, a further embodiment of the fastening of the platform elements 17*a, b* to the main blade or vane part 11 which combines the functions of the mechanical fastening and the sealing with one another. Instead of a non-positively and positively fitting connection by means of the fastening elements groove 22 and hook 23 and also the sealing elements groove 20 and seal 21, as shown by way of example in FIG. 3, an integral connection of these components arises by means of a solidifying filling 30, which can be poured into a locking channel 29 formed between said turbine blade or vane components to be connected. In order to achieve this, the facing joint surfaces of the recess 18 of the platform elements 17*a, b* and also of the blade or vane airfoil 11 or of the shaft 15 of the turbine blade or vane 10 are provided with opposing grooves for the introduction of a pourable filling 30, in particular a molten metal. After the filling material introduced has solidified, for example after it has hardened or cured, the blade or vane components are fixedly connected to one another. In this respect, it is self-evident to select a filling material which remains in the solid state and does not experience any thermal damage under the conditions of the intended use of the turbine blade or vane 10. If the locking channel 29 is continuously formed in such a way that it forms a closed ring around the airfoil 11 or the shaft 15 of the turbine blade or vane 10, this connection performs the dual function of fastening and sealing, since a connection of this type is by nature sufficiently fluid-tight. The requirement for an additional seal between the main blade or vane part 11 or shaft 15 and the platform 17 therefore no longer applies.

The invention achieves mechanical decoupling between the platform and the blade or vane, which avoids undesirable stresses and at the same time is flexible in use and can also be retrofitted without a change to the way in which the blade or vane is fastened.

The invention claimed is:

1. A turbine blade or vane, comprising:

a blade or vane airfoil with a leading edge and a trailing edge, the blade or vane airfoil merging via a shaft into a blade or vane root, the blade or vane root formed for fastening of the turbine blade or vane;

a platform, arranged at a lower end of the blade or vane airfoil to delimit a flow channel, wherein the platform is formed as a separate component and can be connected to the blade or vane airfoil with a positive fit, wherein the platform is composed of a plurality of individual platform elements, which, when assembled, enclose the blade or vane airfoil and wherein the platform elements are each provided with recesses which proceed from a separating plane and, when assembled, form an opening adapted to a profile of the blade or vane airfoil for the blade or vane airfoil passing through the platform; and wherein each platform element includes a protruding portion, a protruding portion of one platform element protruding in a direction of and overlapping with a non-protruding portion of the other platform element and the protruding portion of the other platform element protruding in a direction of and overlapping with a non-protrudinq portion of the one platform element, wherein the protruding elements are offset from one another and a locking channel is formed in the protruding portions and the non-protruding portion of the platform elements facing the protruding portions, the locking channel being filled with a filling.

2. The turbine blade or vane as claimed in claim 1, wherein the platform is composed of two platform elements.

3. The turbine blade or vane as claimed in claim 1, comprising:

a circumferential sealing groove, for receiving a seal, in each platform element for sealing off with respect to the blade or vane airfoil along the opening; and a seal arranged in the circumferential sealing grooves of the platform elements.

4. The turbine blade or vane as claimed in claim 1, wherein the two platform elements are sealed off with respect to one another in the separating plane.

5. The turbine blade or vane as claimed in claim 1, wherein the two platform elements are releasably connected to one another.

6. The turbine blade or vane as claimed in claim 1, wherein the platform is fastened to the turbine blade or vane.

7. The turbine blade or vane as claimed in claim 6, wherein the platform is hooked to the turbine blade or vane.

8. The turbine blade or vane as claimed in claim 7, wherein the platform or the platform elements comprise hooks, for being hooked into a groove in the region of the shaft of the turbine blade or vane.

9. The turbine blade or vane as claimed in claim 6, wherein the platform or the platform elements is integrally connected to the turbine blade or vane.

10. The turbine blade or vane as claimed in claim 9, wherein the blade or vane airfoil or blade or vane shaft and the platform elements are each provided with a groove-like recess, and these groove-like recesses are arranged so as to lie opposite one another in such a manner that they form a locking channel, and this locking channel is filled with a filling.

11. The turbine blade or vane as claimed in claim 10, wherein the locking channel is formed continuously over the circumference of the blade or vane airfoil or blade or vane shaft.

12. The turbine blade or vane as claimed in claim 10, wherein the filling is a castable metal which assumes the solid state under the conditions of the intended use of the turbine blade or vane.

* * * * *